US008218799B2

(12) United States Patent
Murphy et al.

(10) Patent No.: US 8,218,799 B2
(45) Date of Patent: Jul. 10, 2012

(54) NON-OCCLUDING AUDIO HEADSET POSITIONED IN THE EAR CANAL

(76) Inventors: Matthew Stephen Murphy, Boise, ID (US); Mali Kristin Murphy, Boise, ID (US)

( * ) Notice: Subject to any disclaimer, the term of this patent is extended or adjusted under 35 U.S.C. 154(b) by 994 days.

(21) Appl. No.: 12/195,411

(22) Filed: Aug. 20, 2008

(65) Prior Publication Data

US 2009/0052702 A1 Feb. 26, 2009

Related U.S. Application Data

(60) Provisional application No. 60/957,399, filed on Aug. 22, 2007.

(51) Int. Cl.

| | |
|---|---|
| ***H04R 5/033*** | (2006.01) |
| ***H04R 25/02*** | (2006.01) |
| *H04R 5/00* | (2006.01) |
| *H04R 25/00* | (2006.01) |

(52) U.S. Cl. ..... 381/309; 381/328; 381/330; 381/380; 381/381

(58) Field of Classification Search ..... 381/309, 381/325, 328, 329, 330, 322, 324, 380, 381, 381/382; 181/130, 131, 135

See application file for complete search history.

(56) References Cited

U.S. PATENT DOCUMENTS

| | | | | |
|---|---|---|---|---|
| 1,614,987 | A * | 1/1927 | Langenbeck et al. | 181/135 |
| 1,668,890 | A * | 5/1928 | Curran et al. | 181/130 |
| 1,668,910 | A * | 5/1928 | Jones | 181/130 |
| 1,893,143 | A * | 1/1933 | Koch | 181/135 |
| 3,041,856 | A * | 7/1962 | Neal | 63/14.1 |
| 3,667,569 | A * | 6/1972 | Mackey et al. | 181/135 |
| 4,742,887 | A | 5/1988 | Yamagishi | |
| 5,412,736 | A | 5/1995 | Keliiliki | |
| 5,420,930 | A * | 5/1995 | Shugart, III | 381/315 |
| 5,625,171 | A * | 4/1997 | Marshall | 181/130 |
| 5,682,020 | A * | 10/1997 | Oliveira | 181/130 |
| 5,917,918 | A | 6/1999 | Callahan | |
| 6,048,305 | A * | 4/2000 | Bauman et al. | 600/25 |
| 6,181,801 | B1 | 1/2001 | Puthuff et al. | |
| 6,275,596 | B1 * | 8/2001 | Fretz et al. | 381/321 |
| 6,683,965 | B1 | 1/2004 | Sapiejewski | |
| 6,704,429 | B2 | 3/2004 | Lin | |
| 6,819,762 | B2 | 11/2004 | Jones et al. | |
| D506,258 | S * | 6/2005 | Nielsen | D24/174 |
| 6,961,440 | B1 | 11/2005 | Schlaegel | |
| 7,068,803 | B2 * | 6/2006 | Kuhlmann et al. | 381/328 |
| 7,110,562 | B1 | 9/2006 | Feeley et al. | |
| 7,110,563 | B2 | 9/2006 | Bergere | |
| 7,139,404 | B2 | 11/2006 | Feeley et al. | |
| 7,233,676 | B2 * | 6/2007 | Bayer | 381/328 |

(Continued)

*Primary Examiner* — Edgardo San Martin
(74) *Attorney, Agent, or Firm* — James Richards

(57) ABSTRACT

A compact audio speaker assembly that fits into the ear canal without occluding the ear canal, thus allowing ambient sounds to be heard along with the audio source. The ear speaker is secured in the ear canal by a ribbon or wire like spring structure anchoring the speaker to the concha portion of the outer ear and typically pushing the speaker up against the top side of the ear canal, leaving a space for external sounds to bypass the speaker to the eardrum. The speaker may further include a connecting signal cable that passes over the ear and behind the ear to provide additional support for the speaker and strain relief for the signal cable. One embodiment may include a shell over the speaker connected to the wire like spring anchor and may include an ear wax screen. Two speakers may be configured for stereo listening.

20 Claims, 7 Drawing Sheets

U.S. PATENT DOCUMENTS

| | | | | |
|---|---|---|---|---|
| D563,945 | S | 3/2008 | Johns et al. | |
| 7,421,086 | B2 * | 9/2008 | Bauman et al. | 381/328 |
| D588,110 | S * | 3/2009 | Darbut | D14/223 |
| 7,590,255 | B2 * | 9/2009 | Nielsen | 381/328 |
| 7,720,245 | B2 * | 5/2010 | Bauman et al. | 381/330 |
| 7,899,200 | B2 * | 3/2011 | Karamuk et al. | 381/328 |
| D641,883 | S * | 7/2011 | Nielsen | D24/174 |
| 8,014,551 | B2 * | 9/2011 | Iwano et al. | 381/330 |
| 8,059,845 | B2 * | 11/2011 | Bryant | 381/324 |
| 2002/0172386 | A1 * | 11/2002 | Bayer | 381/330 |
| 2003/0112992 | A1 * | 6/2003 | Rapps | 381/381 |
| 2007/0003085 | A1 | 1/2007 | Meier et al. | |
| 2007/0183615 | A1 * | 8/2007 | Wurfel | 381/330 |
| 2009/0092269 | A1 * | 4/2009 | Nielsen et al. | 381/313 |
| 2009/0110227 | A1 * | 4/2009 | Prince | 381/380 |
| 2010/0312040 | A1 * | 12/2010 | Puria et al. | 600/25 |

* cited by examiner

NON-OCCLUDING AUDIO HEADSET POSITIONED IN THE EAR CANAL

RELATED APPLICATIONS

This application claims the benefit under 35 USC 119(e) of provisional application Ser. No. 60/957,399, filed Aug. 22, 2007 by Matthew Stephen Murphy, which is hereby incorporated herein by reference in its entirety.

BACKGROUND

1. Field of the Invention

The present invention pertains generally to the field of audio listening devices, more particularly to the field of listening devices to be worn by the listener.

2. Background of the Invention

Headsets for use with audio output devices such as music playing devices, cell phones and the like, have become smaller and lighter to keep up with the decreasing size and weight of the associated audio device. With the advent of Walkman® and other compact players, lightweight headsets were offered that allowed the listener to walk or jog while wearing the player and not feel constrained by carrying heavy equipment. These headsets were typically ear-sized speakers with foam pads joined by a spring strap that fit over the head. Later headsets were smaller. Some headsets used in telecommunications were designed for use on a single ear, leaving the other ear open for receiving room audio and carrying on face to face conversations, while staying connected to the telephone using the other ear. These headsets fit on the ear, sometimes having a portion fitting in the ear canal, and often including a short boom microphone to pick up voice.

Audio devices continue to get smaller with the consequence that the headset is becoming larger than the audio device, limiting the ultimate size of the device/headset combination and presenting storage difficulties when not in use. For many applications, such as music players, stereo listening is preferred for maximum enjoyment, yet for driving, walking, jogging, operating machinery, and other activities, the ability to hear ambient sounds is a desirable safety feature.

Thus, there is a need for a very small headset that allows ambient sounds to be heard while listening to an audio source, and preferably also allows stereo listening.

BRIEF DESCRIPTION OF THE INVENTION

Briefly, the present invention pertains to a compact audio speaker assembly that fits into the ear canal without occluding the ear canal, thus allowing ambient sounds to be heard along with the audio source. The ear speaker is secured in the ear canal by a ribbon or wire like spring structure anchoring the speaker to the concha portion of the outer ear and typically pushing the speaker up against the top side of the ear canal, leaving a space for external sounds to bypass the speaker to the eardrum. The speaker may further include a connecting signal cable that passes over the ear and behind the ear to provide additional support for the speaker and strain relief for the signal cable. One embodiment may include a shell over the speaker connected to the wire like spring anchor and may include an earwax screen. Two speakers may be configured for stereo listening.

These and further benefits and features of the present invention are herein described in detail with reference to exemplary embodiments in accordance with the invention.

BRIEF DESCRIPTION OF THE FIGURES

The present invention is described with reference to the accompanying drawings. In the drawings, like reference numbers indicate identical or functionally similar elements. Additionally, the left-most digit(s) of a reference number identifies the drawing in which the reference number first appears.

DETAILED DESCRIPTION OF THE INVENTION

Figure 1:
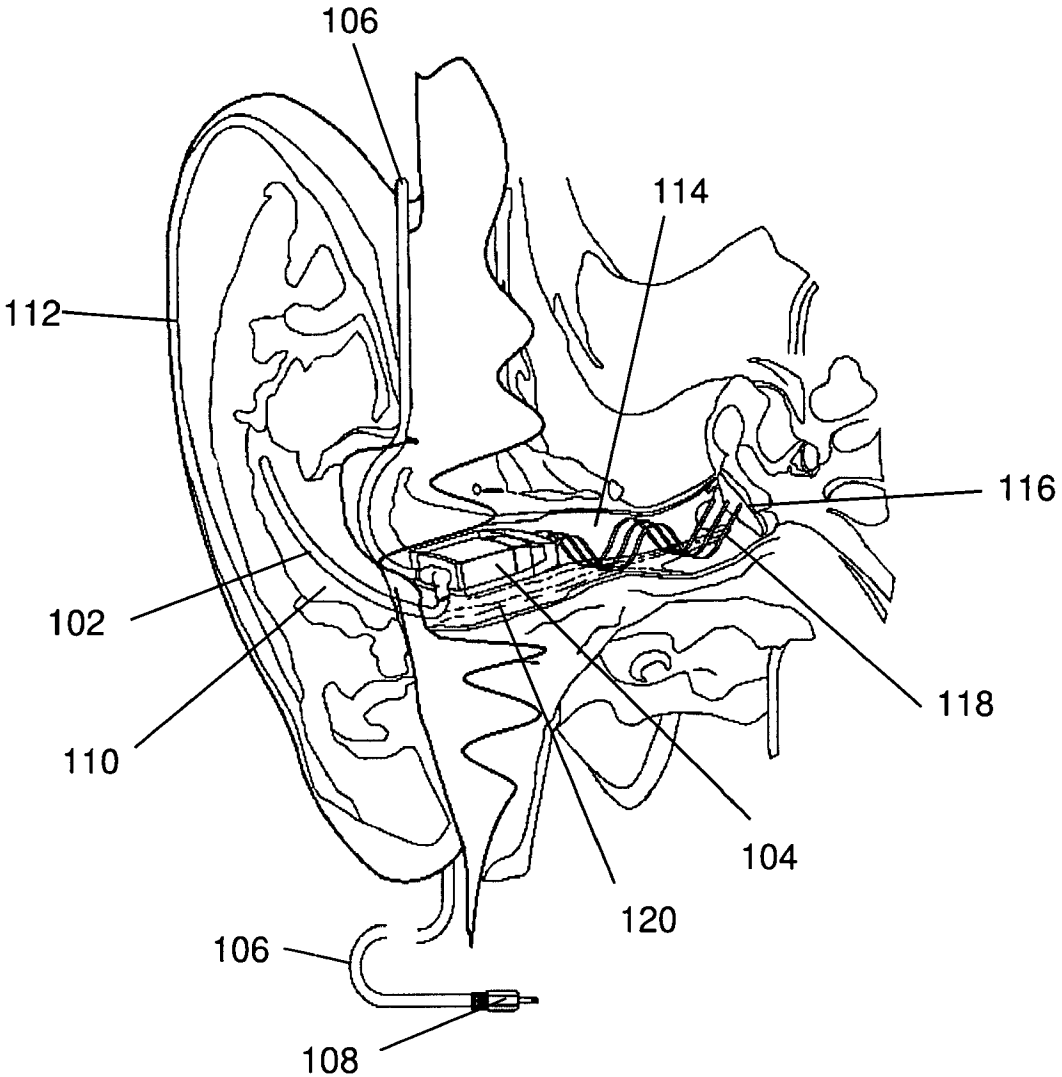
FIG. 1 is a partial cut away view of one ear speaker positioned in the upper portion of an ear canal and secured with a concha spring anchor in accordance with the present invention.

The present invention pertains to a speaker that may be placed in the ear canal without blocking the ear canal so as to allow ambient sounds to be heard as well as source audio delivered by the speaker. The speaker is positioned at the top of the ear canal by a flexible wire or ribbon structure that anchors the earpiece to the concha portion of the ear. The concha anchor presses downward against the concha to lift the earpiece to the upper ear canal. The earpiece may also have a non-cylindrical shape to further assure that the earpiece will not fit snuggly to the ear canal thereby blocking the ear canal, and will allow a substantial passage for ambient sounds to bypass the speaker, and be heard through the eardrum.

Thus, the ear speaker provides numerous advantages. The ear speaker is very small in size, much smaller than over the ear earphones commonly used with portable devices. The ear speaker is small enough so that a stereo pair can be carried with even the smallest audio devices now available such as IPOD® or competing brands. The stereo pair can be carried in a case with the audio device without significantly increasing the size of the audio device and case. For example, a 10 cubic centimeter (cc) audio device could be made with a compartment for stowing the earphones consuming on the order of 2 cc of volume, a small volume change. Whereas some headphones double the size of the combined package, a substantial volume change.

A second group of advantages relates to safety and work effectiveness. In many situations, it is desirable or necessary to hear ambient sounds. The present invention allows the reception of sound from the speaker without impairing the hearing of ambient sounds. A driver of a car or operator of machinery may now listen to music while maintaining sensitivity to ambient sounds. Thus, the driver may respond to emergency sirens, nearby traffic, or changes in mechanical sounds from the automobile that would be impeded by over the ear or ear canal blocking earphones. Furthermore, a stereo headset in accordance with the present invention fits symmetrically in both ears. Because any slight affect on the ambient sound due to the presence of the ear speakers is symmetrical, directional perception is preserved. Thus, not only can the presence of ambient sounds be perceived, but also the direction of the sound source may be determined. Furthermore, because both ears hear ambient sounds, ambient sounds may be heard from all around the head. Even in a single ear speaker embodiment of the present invention, the effect of the presence of the ear speaker on ambient sounds is slight, allowing the wearer to hear sounds all around the head and to perceive the direction of the sounds. This is in contrast to one conventional way to hear ambient sounds, which is to use a single headphone covering one ear, leaving the second ear exposed to ambient sounds. In the single covered ear headphone system, ambient sounds are blocked in the covered ear, thus the direction of the ambient sounds cannot be as easily perceived. Furthermore, ambient sounds from the direction of the covered ear are attenuated at the opposite ear so that sounds from all around are not uniformly heard. A further problem with the single covered ear headset is that stereo program content cannot be delivered. Thus, the present invention improves the safety by allowing all around ambient sound with direction sensing while delivering full stereo program content to the listener.

In a further advantage of the present invention, the invention allows normal feedback from the hearing of one's own voice. When a person is wearing typical ear canal blocking devices, there is difficulty monitoring one's own voice and the result is that one typically speaks very loudly in order to hear ones own voice at a normal level. With the present invention, the ear canal remains open and the person can hear his or her own voice as well as that of others. Thus, one can carry on a normal conversation at a natural voice level without the disruptive effect of speaking at an extra loud voice level. This natural conversation advantage can be especially valuable at the work place, anywhere there is a quiet environment, or for use with a cell phone or walkie-talkie.

In still a further advantage, the arrangement of the spring member to secure the speaker into the ear canal is sufficiently flexible to fit most adults with a single design, eliminating the custom fitting operations associated with hearing aids and eyeglasses, and allowing mass marketing of a single design.

Thus, the present invention allows very small ear sets in keeping with today's micro miniaturization of stereo audio program material players without interfering with the hearing and direction perception of ambient sounds and without disrupting the normal hearing and volume leveling of one's own voice, thus enhancing safety and work effectiveness.

The present invention will now be described with reference to the drawings.

FIG. 1 is a partial cut away view of one ear speaker positioned in the upper portion of an ear canal and secured with a concha spring anchor in accordance with the present invention. Referring to FIG. 1, the ear speaker 104 is shown positioned in the upper (superior) portion of the ear canal 114, leaving a space 120 below the speaker 104 for passage of ambient sounds from outside to the eardrum 116. The speaker 104 is held in the upper canal position by a flexible spring member 102. The spring member 102 is made of resilient flexible metal or plastic material that bends and returns to the original shape. The spring member fits in the lower bowl (concha 110) of the outer ear 112. The spring member presses against the concha, forcing the speaker to the superior portion of the ear canal and pushes the speaker into the ear canal toward the eardrum to retain the speaker in position. Thus, the speaker 104 contacts and presses against one side of the ear canal 114 and has no contact with the opposite side of the ear canal 114. The outside end of the speaker (connection end) is typically at or near the opening of the ear canal with the speaker body inside the ear canal. The speaker is connected to a signal cable 106 that runs from the speaker 104 up and over the ear helix (where the helix joins the scalp) and behind the ear, with additional free length terminating in a connector 108. Connector 108 may be an earphone connector constructed according to one of the standards typically used for earphones, however, specialized connectors may be used. The signal cable 106 typically includes two conductors of multiple strands of fine stranded wire for maximum flexibility and durability. Any suitable flexible and durable cable may be used.

Figure 2:
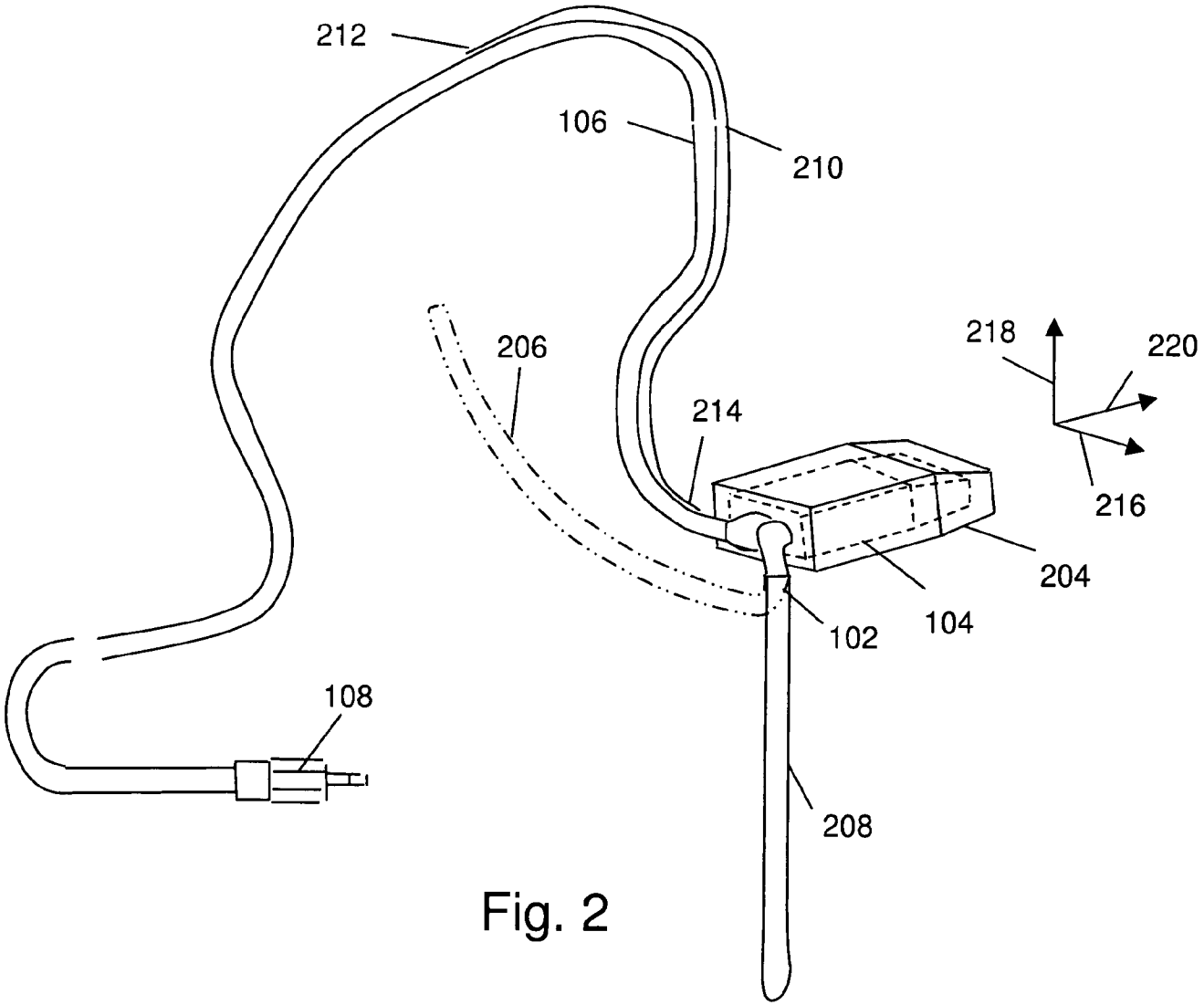
FIG. 2 illustrates the single speaker of FIG. 1 without showing the ear structure.

FIG. 2 illustrates the single speaker of FIG. 1 without showing the ear structure. Referring to FIG. 2, the speaker is shown with the spring member and signal cable. The spring member 102 is shown in both a relaxed position 208 and the deflected position 206. The deflected position 206 showing the spring as the spring would be when acting on the concha of the ear (see FIG. 1).

For clarity of discussion, directions are shown using arrows 216, 218, and 220. Arrow 220 is along the axis of the ear canal. The arrow 220 points toward the eardrum from the speaker. Positions along axis 220 closer to the eardrum may be termed proximal. Positions farther away may be termed distal. Arrow 218 shows upward, or top or superior, toward the top of the head. Opposite arrow 218 is downward, bottom, inferior. Arrow 216 is forward, or toward the listener's face. Opposite arrow 216 is rearward, backward, back side, toward the back of the listener's head. In the exemplary design shown, the speaker sound output is from the proximal end of the speaker, and the electrical connections are on the distal end of the speaker. Depending on context, the output end may be termed the front and the connection end may be termed the back of the speaker, not to be confused with forward and rearward, relating to the head.

Typical dimensions for the exemplary speaker 104 are:

5.0 millimeters (mm) in length, along the axis of the ear canal, 2.73 mm in height, and 3.86 mm in width.

The speaker as shown, has an optional plastic shell cover 204 to protect the speaker 104, the connections to the cable 106 and the connection to the spring member 102. The cover may add 1 mm to the height and width and may add 3 mm to the length.

These dimensions are suitable for the external auditory canal of an exemplary typical person having a typical ear canal with a diameter 7 mm and length from 23 to 30 mm. Thus, the cross sectional area of the speaker is 2.73 mm×3.86 mm=10.54 $mm^2$, which is less than 30% of the cross sectional area of the 7 mm diameter ear canal, which is about 40 $mm^2$ ($\pi r^2=3.14\times3.5^2=38.5$ $mm^2$). The cross sectional area of the speaker is preferably less than 70% (about 28 $mm^2$) of the cross sectional area of the ear canal, more preferably less than 50% (about 20 $mm^2$) and more even more preferably less than 30% (about 12 $mm^2$) of the cross sectional area of the ear canal. Since the cross sectional area of the ear canal can be expected to be about 40 $mm^2$, the 2.73 mm×3.86 mm speaker would meet the preference value (about 28 $mm^2$) for a wide range of ear canal diameters and would fit most adults. A model ear canal may be defined as an ear canal of nominal expected dimensions, in particular the 40 $mm^2$ cross section previously mentioned.

Because the speaker is smaller than the diameter of the typical ear canal, the speaker alone does not have enough width to secure the speaker into the canal. Thus, the spring member is provided to push the speaker into the upper side of the ear canal.

In addition to having a slight horizontal pushing force, the spring also has a vertical pushing force. Due to the downward force of the spring against the concha, the speaker is forced against the superior side of the ear canal. The deflected position of the spring member can also produce a slight torque around the longitudinal axis of the speaker. This rotational torque can be resisted by the slight stiffness of the cable. In addition, in one embodiment, the spring member attachment to the speaker may be slightly forward of the center of the speaker (toward the person's face), allowing the speaker contact with the ear canal to resist the torque from flexing the spring member.

In the configuration of FIG. 2, the spring is connected to the speaker at the back of the speaker (end distant from the ear drum) toward the forward side (toward the listener's face) of the back of the speaker. As the spring is deflected into position, a forward and upward force is delivered to the speaker at the spring attachment point. In addition, a rotational torque is generated that serves to push the rearward side (toward the back of the head) of the speaker up against the top of the ear canal.

In one embodiment, the end of the speaker with the cable and spring attachment may be over molded with an injection mold to better support and attach the cable and spring. Alternatively, a plastic may be applied to the end of the speaker to secure the cable and spring.

A replaceable plastic screen may be placed at the proximal end of the speaker housing in order to protect the speaker from earwax. The speaker could be designed to use a plastic screen as is typically available in the hearing aid industry for hearing aids. (see FIG. 6 and FIG. 7)

The spring member 102 can be made of many different materials including plastic, silicone, wire, and other flexible resilient materials. In one exemplary embodiment, the spring is straight and thin of approximately 3.8 cm in length and the diameter of 22 gauge wire (0.025 inch, 0.635 mm). Preferably between 3 and 5 cm in length and preferably between 0.5 and 1 mm in diameter for polyamides (for example, Nylon®) and other plastics. In one embodiment, the spring may be a polyamide coated spring steel wire. The 3.8 cm length typically allows the spring to fit in the concha behind the tregus of the ear.

In normal use, the spring 102 operates within the elastic deformation range and does not undergo plastic deformation i.e., when bent for insertion into the ear, elastic limits are not reached such that upon removal from the ear, the spring will return to the original straight form. Thus, when flexed in the concha 110, the spring 102 provides a force to lift the speaker 104 both up against the superior portion of the ear canal 114 and inward toward the eardrum 116. Inward movement of the speaker into the ear canal 114 is limited by the spring 102, the cable 106 and, when used, the strain relief section 210. As the speaker 104 moves into the ear canal 114, at some point, the side of the spring 102 and the cable strain relief 210 begin to contact the external side of the ear, limiting further movement into the ear canal 114. The cable and strain relief section 210 also act to prevent the speaker 104 from tilting downward at the front of the speaker (proximal end) by pulling back on the rear of the speaker (distal end). Slight electrical cable stiffness at the connection to the speaker will also help prevent tilting of the speaker 104.

The spring member 102 is fixedly attached to the speaker 104 and is integrated into the speaker 104. The attachment may be located on the distal end of the speaker adjacent to the positive and negative terminals of the electrical signal connection. When the speaker is out of the ear, the spring maintains a straight form pointing down (when the speaker axis is horizontal as it would be in the ear canal, see FIG. 2). To insert the device, the user picks up the spring rearward, placing the spring into the bowl of the ear (concha) and the speaker into the ear canal. Once placed in the concha bowl, the spring applies a spring effect (because the spring tends to return to the spring's natural straight position), pushing the speaker into the ear canal toward the ear drum as well as pushing the speaker up to the top of the ear canal, forcing the speaker to the superior portion of the ear canal, thus leaving a vent in the lower portion of the canal allowing natural environmental sounds to enter the canal at the same time that the speaker generated signal may be sent in the ear canal.

The cable may be a standard gauge as is typically used in many headphone applications. The cable may have a 3.5 mm jack at one end and the stereo embodiment may have a "Y" cord at the other end with a positive and negative wire on each side of the "Y".

The signal cable 106 may include an optional strain relief and support section 210 extending from the speaker at point 214 up and over the ear to a point 212 behind the ear auricle (also referred to as pinna). The strain relief portion and cable make a 90 degree turn as the cable exits the ear canal to go up and over the ear. The strain relief section 210 may be a pliable, bendable, semi rigid section providing additional support for the speaker and acting as strain relief to prevent slight movements or tugging on the cable from displacing the speaker. The strain relief section may be sufficiently rigid to provide support and strain relief, but bendable and deformable to be adjusted for each particular listener.

The strain relief section 210 may be an over-molded section of the cable, or may be a separate injection molded piece with a hollow core through which the cable is fed. The strain relief 210 may also include a length of solid bendable and deformable wire e.g., annealed copper or steel, to allow the section to take a desired shape. The strain relief section 210 may be typically 5 cm in length, but may be between 3 cm and 8 cm or more. The strain relief section 210 may begin at the speaker and may thus provide additional support for the speaker, or may begin after a length of 0.5 to 2 cm from the speaker to more allow flexibility at the speaker.

Figure 3A:
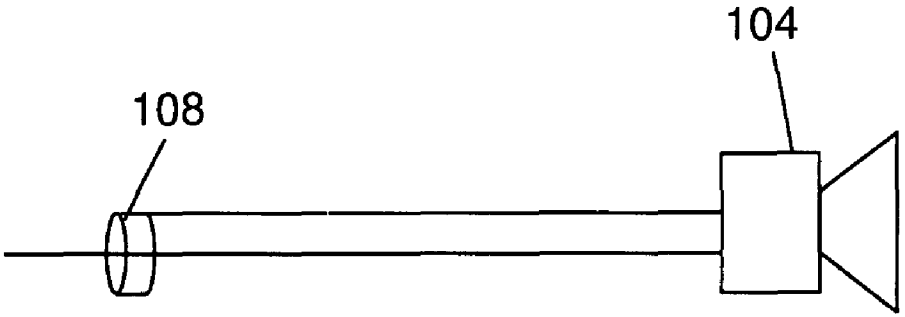
FIG. 3A and FIG. 3B show exemplary schematic diagrams for a single ear speaker.
Figure 3B:
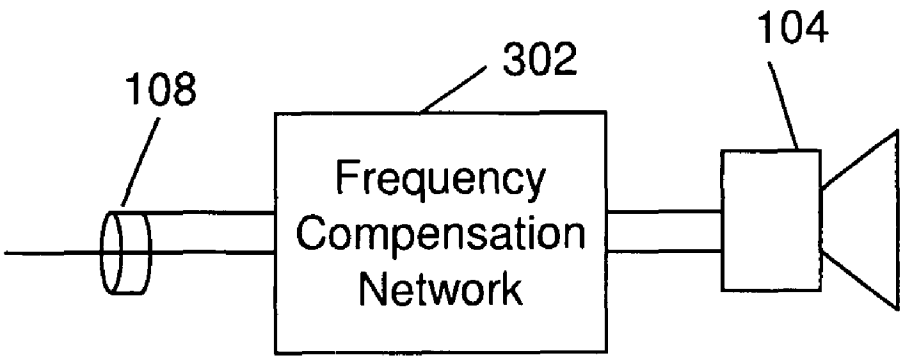

FIG. 3A and FIG. 3B show exemplary schematic diagrams for a single ear speaker. Referring to FIG. 3A, the speaker element 104 may be wired through a cable to a connector which may be plugged into an audio source. A typical ear speaker made for hearing aid applications may be designed to perform best in a closed ear canal configuration. The open configuration, i.e., allowing the passage under the speaker for ambient sounds, may reduce the low frequency response of the speaker. It may be found; however, that the listener will get used to the frequency response and mentally adjust for the effect, deriving enjoyment from the music as well as the safety and other benefits of the present headset. Some applications, such as receptionist or call center operator, will not present low frequency audio and thus have no issue. For music applications, however, it may be desirable to improve the low frequency response.

FIG. 3B shows an exemplary schematic of a device including frequency compensation. FIG. 3B shows an electrical frequency compensation network 302. To minimize in-ear size, the electrical components may be placed in the connector or in the cabling. Alternatively, the audio source may be tailored to a specific ear speaker device and include compensation in the audio source device. Alternatively, the audio source device may include a graphic equalizer or bass and treble control that may be used to tune the system for the listener. Alternatively, the mechanical design of the speaker may take into consideration, the open configuration and adjust the response accordingly.

FIG. 3A and FIG. 3B show the speaker system as an entirely passive system, i.e., no active components such as amplifiers or active filters. Alternatively, the system may include active components. Also, the system is shown without a microphone and amplifier feeding the speaker as typically used for a hearing aid device. The extreme open configuration in the ear canal would present feedback issues if a microphone driving the speaker were configured with the speaker. Hearing aids with integral microphones typically block the ear canal and may have a small port for pressure equalization, but not the large open space of the present invention.

Figure 4:
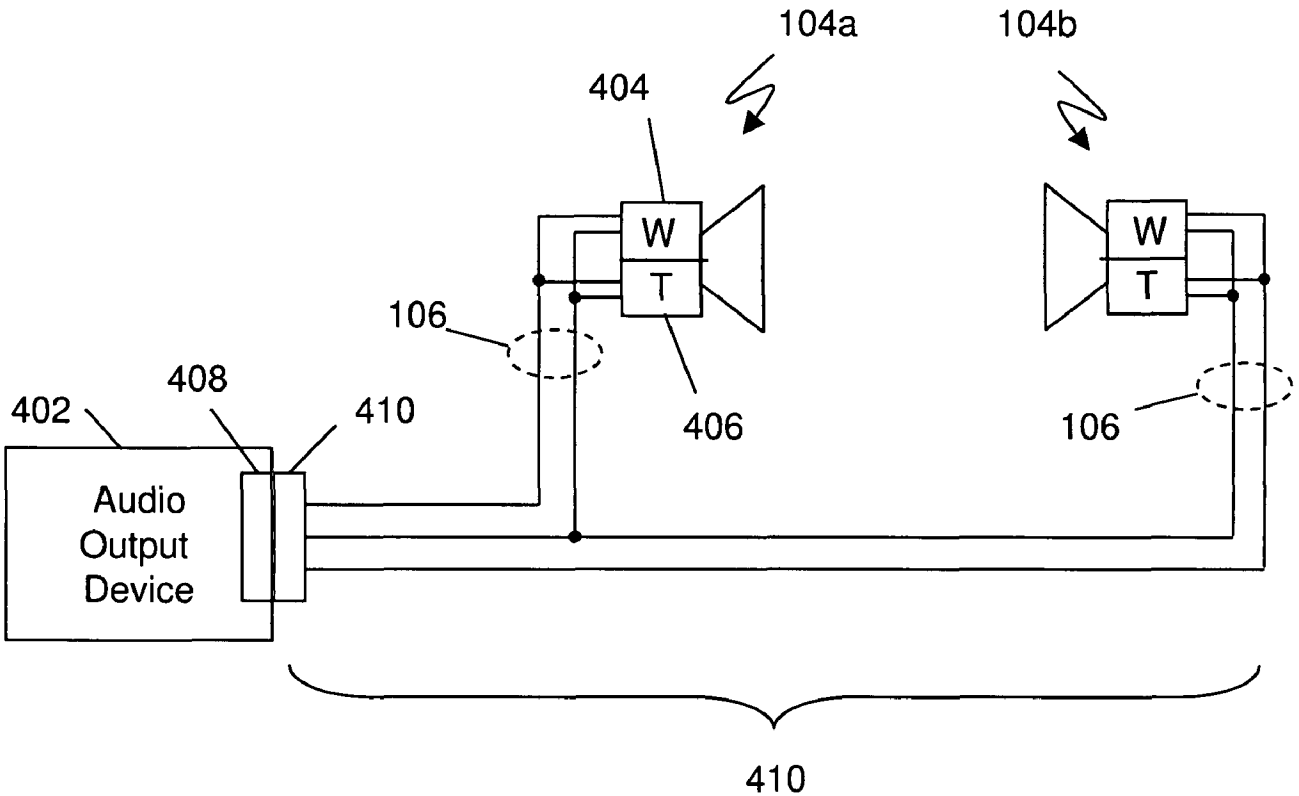
FIG. 4 illustrates an exemplary stereo configuration including a speaker assembly for each ear, each speaker assembly comprising a woofer and a tweeter.

FIG. 4 illustrates an exemplary stereo configuration including a speaker assembly for each ear, each speaker assembly comprising a woofer and a tweeter. Referring to FIG. 4, the ear speaker set 410 includes an ear speaker 104*a* for the left ear and another ear speaker 104*b* for the right ear and may include a stereo plug 410. The plug 410 is shown connected to a stereo jack 408 in an audio output device 402. Also shown is a woofer-tweeter alternative for the ear speaker; however, the woofer-tweeter is not necessary for stereo. A single speaker for each side may be used. As shown, each speaker 104*a* or 104*b* comprises a woofer 404 and tweeter 406 driven in parallel, the woofer 404 performing best at low frequencies and the tweeter 406 performing best at high frequencies. The woofer-tweeter configuration can potentially allow frequency response adjustment by attenuating the woofer or the tweeter, in particular attenuating the tweeter to cut the high frequencies and thus enhance the low frequencies. Series resistance or pad networks may be used (not shown). Alternative techniques known in the art for desensitizing the response may also be used. In FIG. 4, the woofer and tweeter are shown connected in parallel. Alternatively, a crossover network may be used to direct high frequencies to the tweeter and low frequencies to the woofer and may be designed in accordance with techniques known by those skilled in the art. Since power efficiency is usually not as important for earphones as for full size room speakers, the woofer and tweeter may typically be designed for parallel connection without a crossover network.

Speakers used for the headset may be obtained from sources supplying the hearing aid market. In particular a woofer-tweeter pair, part number: TWFK-30017-000 made by Knowles Electronics of Itasca, Ill. may serve well in this application. An exemplary single speaker may be FK 23451-000, also by Knowles. Other speakers made by Knowles or other manufacturers may also serve well.

Figure 5:
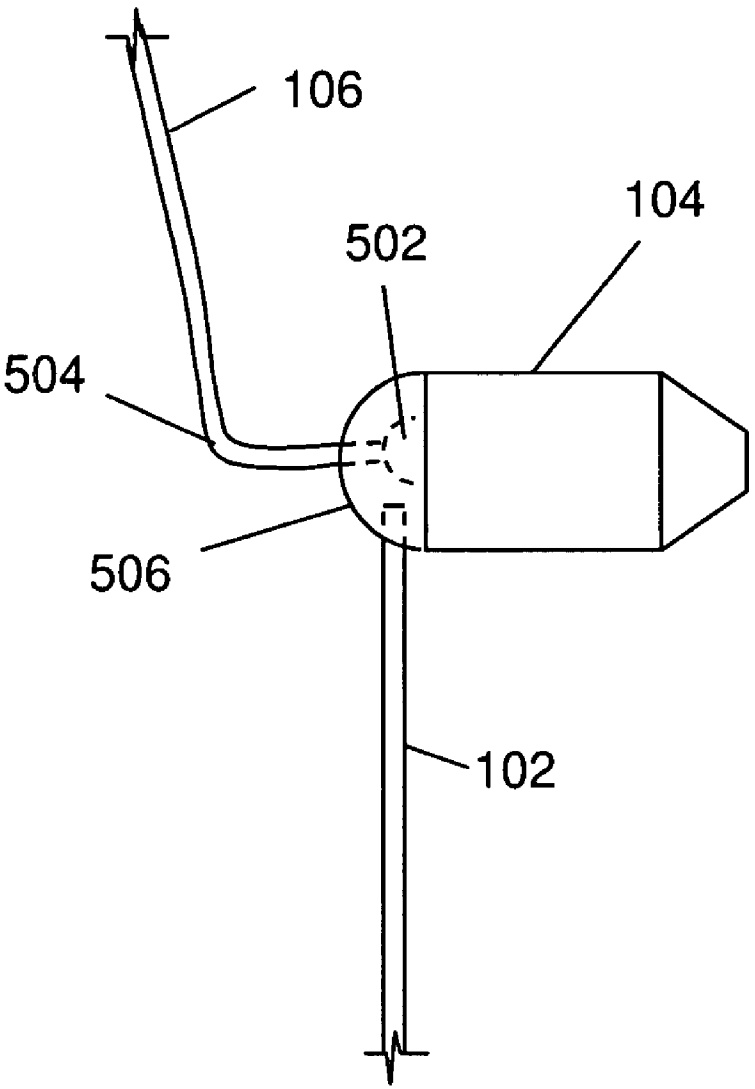
FIG. 5 illustrates a side view of an exemplary ear speaker assembly in accordance with the present invention.

FIG. 5 illustrates a side view of an exemplary ear speaker assembly in accordance with the present invention. Referring to FIG. 5, the speaker 104 is shown connected to the cable 106 at a solder point 502. (There are actually typically two solder points, one for each wire of the cable.) The connection end of the speaker includes a plastic covering 506 to protect the cable connection 502. The plastic covering 506 also may embed and attach the spring member 102. The plastic covering 506 may be an adhesive, such as epoxy, or may be an injection molded thermoplastic. As the cable 106 leaves the speaker 104, the cable extends first along the axis of the speaker and then makes a right angle bend 504 to go up and over the ear. The spring member preferably extends downward from the end of the speaker, at a substantial right angle (typically greater than 60 degrees) to the speaker axis (FIG. 2, ref 220).

Figure 6:
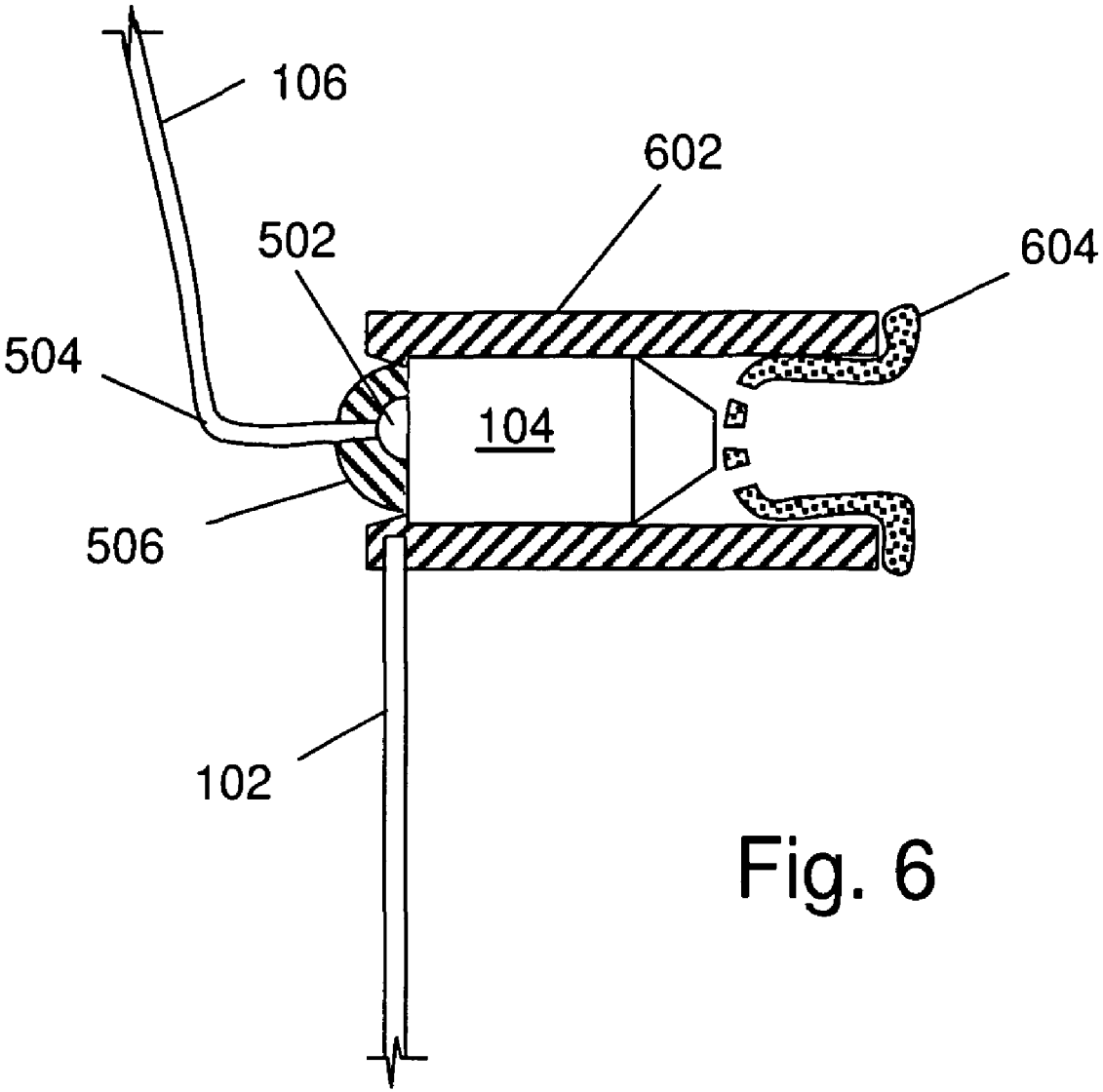
FIG. 6 illustrates a side cross section view of an exemplary ear speaker assembly with a plastic shell covering and an ear wax screen.

FIG. 6 illustrates a side cross section view of an exemplary ear speaker assembly with a plastic shell covering and an ear wax screen. Referring to FIG. 6, the speaker 104 is shown with a plastic adhesive covering 506 to protect the solder connection 502 as in FIG. 5; however, the spring member 102 is attached directly to a plastic shell 602, which may be assembled over the speaker 104. The plastic shell 602 may partially or completely surround the body of the speaker 104. The plastic shell 602 may also be configured to receive a removable and replaceable earwax screen 604. The plastic shell 602 may be separately injection molded and assembled with the speaker 104 during manufacturing. The shell 602 may be designed to be snapped into place or may be adhesively bonded to the speaker 104.

Figure 7:
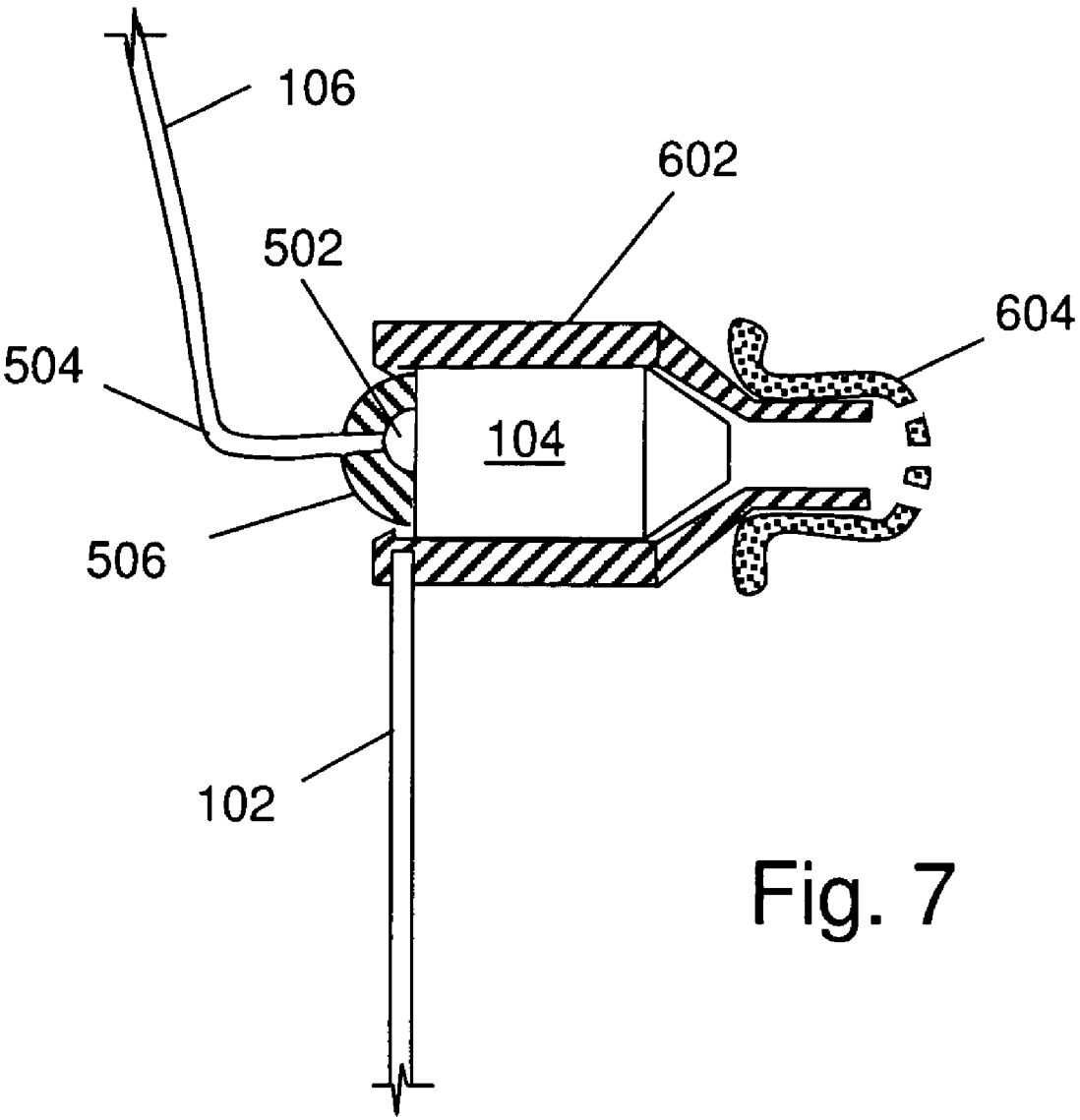
FIG. 7 shows an alternative speaker cover with an external mounting for the earwax screen of FIG. 6.

FIG. 7 shows an alternative speaker shell with an external mounting for the earwax screen of FIG. 6.

The audio output device may be a music source such as an IPOD®, an MP3 player, a personal digital assistant (PDA), a portable CD or tape player, a walkie-talkie, a cell phone or other audio device. The device may be a BLUETOOTH® receiver associated with a cell phone or other device. The audio device may be configured as a behind the ear (BTE) device, or may be clipped to the clothing, in a pocket in the clothing, or worn on a belt. Further mounting alternatives include, but are not limited to on eyeglasses or on a helmet.

The present invention has numerous uses, in particular, for listening to music at work or anywhere that ambient sounds are important. Thus, a worker may listen to music, without disturbing others with different taste for music or who may be distracted by the music, and the worker may still be fully responsive to verbal communications with other workers and can perceive and respond to events and dangers happening around the worker, since directional perception is preserved. Listeners can benefit from the compact size of the combined music player and headset. Since the combination can be carried in a small pocket or purse, the combination can be carried nearly everywhere. The small size of the headset can allow the headset to be stowed in a compartment in a cell phone designed for the headset, without adding significantly to the size of the cell phone.

Uses extend to other uses besides music, including but not limited to work related audio content. For example, teams of workers in a warehouse may communicate by radio using the headset and still be cognizant of events and dangers in the environment.

In a further benefit, it has been found that, because of the listener being able to hear his or her own voice, the listener does not tend to raise their voice when wearing the present invention as one tends to do when wearing an ear covering headset that blocks outside sounds. Thus, in a work environment or other context of interaction with others, the listener can easily maintain normal conversation while wearing the present invention.

CONCLUSION

The present invention has been described above with the aid of functional building blocks illustrating the performance of specified functions and relationships thereof. The boundaries of these functional building blocks have been arbitrarily defined herein for the convenience of the description. Alternate boundaries can be defined so long as the specified functions and relationships thereof are appropriately performed. Any such alternate boundaries are thus within the scope and spirit of the claimed invention.

While various embodiments of the present invention have been described above, it should be understood that they have been presented by way of example only, and not limitation. Thus, the breadth and scope of the present invention should not be limited by any of the above-described exemplary embodiments, but should be defined only in accordance with the following claims and their equivalents.

What is claimed is:

1. An audio system for delivering acoustic audio to a listener comprising:

an audio source providing an audio signal representing audio from other than ambient sounds; said audio signal including frequency components in a bass range;

a first speaker responsive to said audio signal of said audio source, said first speaker capable of insertion into an ear canal without occluding the ear canal; said speaker assembly for listening to an audio source while allowing ambient sounds to be heard through the ear canal; said first speaker having a cross sectional area less than 30 square millimeters through a plane perpendicular to an ear canal axis when inserted into the ear canal; said first speaker having a proximal end close to the ear drum and a distal end distant from the ear drum when the first speaker is inserted into the ear canal;

a spring member attached to said first speaker at the distal end of said first speaker; said spring member for holding said first speaker against one side of said ear canal by pressing against the ear concha when the speaker assembly is installed in the ear;

an electrical signal cable for delivering said audio signal to said first speaker; said electrical signal cable also for looping over the ear to provide mechanical positioning support for said first speaker when said speaker assembly is installed in said ear.

2. The audio system in accordance with claim 1, wherein the electrical signal cable includes a semi rigid section from a point near the first speaker to behind the ear when the speaker assembly is installed in the ear; said semi-rigid section sufficiently rigid to provide strain relief for the electrical signal cable, but deformable to be adjusted for a particular listener.

3. The audio system in accordance with claim 2, wherein the semi rigid section includes a deformable wire provided in addition to the electrical signal wires comprising said cable.

4. The audio system in accordance with claim 1, wherein the spring member has a length between 3 and 5 centimeters.

5. The audio system in accordance with claim 1, wherein the spring member comprises a resilient plastic.

6. The audio system in accordance with claim 5, wherein the thickness of the spring member is between 0.5 mm and 1.0 mm.

7. The audio system in accordance with claim 1, wherein the spring member is attached to the first speaker at the distal end of the first speaker.

8. The audio system in accordance with claim 1, wherein a length dimension of the spring member forms a right angle with the first speaker longitudinal axis.

9. The audio system in accordance with claim 1, wherein the cable departs from the first speaker initially parallel to the first speaker longitudinal axis and makes right angle bend up toward the top of the ear pinna.

10. The audio system in accordance with claim 1, wherein the first speaker comprises a woofer and a tweeter.

11. The audio system in accordance with claim 1, further including a second speaker configured with a second spring member and a second electrical cable in the manner of the first speaker; said second speaker for use with the opposite ear; wherein the first speaker and second speaker are wired to receive separate left and right audio signals from a stereo signal source.

12. The audio system in accordance with claim 1, wherein the frequency response has been adjusted for operation in a non-occluded ear canal configuration.

13. The audio system in accordance with claim 12, having a first response to a high frequency and a second response to a low frequency, said low frequency lower than said high frequency; wherein said first frequency response has been reduced to increase the relative strength of said second frequency response.

14. The audio system in accordance with claim 1 further including a cover fitting at least partially around the body of the speaker; wherein the spring member is attached directly to the cover.

15. The audio system in accordance with claim 1 further including a cover fitting at least partially around the body of the speaker; wherein an ear wax screen is fitted to the cover.

16. A stereo system comprising:

an audio source providing an audio signal representing audio from other than ambient sounds; said audio signal including frequency components in a bass range; and a headset assembly comprising:

a first ear speaker assembly and a second ear speaker assembly for insertion into respective ear canals without occluding either respective ear canal, said headset assembly for listening to an audio source while allowing ambient sounds to be heard through each of the respective ear canals, each said ear speaker assembly comprising:

an ear speaker having a cross sectional area less than 28 square millimeters through a plane perpendicular to an axis of said respective ear canal when inserted into said respective ear canal; each said ear speaker having a proximal end close to a respective ear drum and a distal end distant from a respective ear drum when each said ear speaker is inserted into said respective ear canal;

a spring member attached to said ear speaker at the distal end of said ear speaker; said spring member for holding said ear speaker against one side of said respective ear canal by pressing against a respective ear concha when the speaker assembly is installed in the respective ear canal;

an electrical signal cable for delivering an audio signal to said ear speaker; said electrical signal cable also for looping over a respective ear pinna to provide mechanical positioning support for said ear speaker when said ear speaker assembly is installed in said respective ear canal.

17. The stereo system in accordance with claim 16, wherein the electrical signal cable includes a semi rigid section from a first point near the speaker to a second point behind the respective ear pinna when the speaker assembly is installed in the ear; said semi-rigid section sufficiently rigid to provide strain relief for the electrical signal cable, but deformable to be adjusted for a particular listener.

18. The stereo system in accordance with claim 16, wherein the spring member has a length from 3 to 5 centimeters.

19. The stereo system in accordance with claim 16, wherein the ear speaker comprises a woofer and a tweeter.

20. A method for providing stereo audio to a listener comprising:

providing a pair of speakers, each speaker of said pair of speakers having a speaker cross section less than seventy percent of the cross section of a model ear canal, said cross section of each said model ear canal being 40 square millimeters;

attaching a respective spring member to each of said speakers to allow said each of said speakers to be held in the superior portion of a respective ear canal, allowing passage of ambient sound around said speaker when in said respective ear canal; said spring member to be positioned in a respective concha portion of a respective ear;

mechanically and electrically coupling a respective cable to each said speaker, said respective cable capable of running up, over, and behind a respective ear pinna to provide positioning support to each said speaker in addition to support provided by each said respective spring member; and coupling said pair of speakers to an audio source capable of sourcing a bass component of audio content.

* * * * *